US008418459B2

(12) United States Patent
Finkbeiner et al.

(10) Patent No.: US 8,418,459 B2
(45) Date of Patent: Apr. 16, 2013

(54) EXHAUST SYSTEM

(75) Inventors: Gotz Finkbeiner, Calw (DE); Jorg-Uwe Muller, Filderstadt (DE); Georg Wirth, Kirchheim/Teck (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 833 days.

(21) Appl. No.: 12/499,365

(22) Filed: Jul. 8, 2009

(65) Prior Publication Data

US 2010/0005798 A1 Jan. 14, 2010

(30) Foreign Application Priority Data

Jul. 8, 2008 (DE) ..... 10 2008 031 887

(51) Int. Cl.
*F02D 23/00* (2006.01)
*F01N 3/02* (2006.01)
*F01N 1/00* (2006.01)

(52) U.S. Cl.
USPC ..... 60/602; 60/321; 60/322; 60/323

(58) Field of Classification Search ..... 60/605.2, 60/272, 321–323, 312–314, 602; 123/193.1, 123/193.5; *F01N 7/08, 7/14, 13/08; F02B 37/02, F02B 37/013, 33/44*
See application file for complete search history.

(56) References Cited

U.S. PATENT DOCUMENTS 1,941,537 A * 1/1934 Boosey ..... 285/42
1,973,304 A * 9/1934 Boosey ..... 285/42
2,423,462 A * 7/1947 Mercier ..... 285/41
2,737,171 A * 3/1956 Torre ..... 123/193.1
2,774,618 A * 12/1956 Alderson ..... 285/261
3,635,031 A * 1/1972 Haddad ..... 60/307
3,776,201 A * 12/1973 Sabet ..... 60/308
3,864,909 A * 2/1975 Kern ..... 60/323
3,983,696 A 10/1976 Pflugfelder ..... 60/272
4,124,977 A * 11/1978 Sakurai ..... 60/322
4,206,600 A * 6/1980 Feuling ..... 60/312
4,294,073 A * 10/1981 Neff ..... 60/597
4,855,555 A * 8/1989 Adams et al. ..... 219/753
5,406,795 A * 4/1995 Raub et al. ..... 60/605.1
(Continued)

FOREIGN PATENT DOCUMENTS

DE 27 22 052 A1 11/1978
DE 3702205 A1 * 8/1988
(Continued)

OTHER PUBLICATIONS

A Machine Translation of Best Roland et al. (Pub. No. DE 44 09 025 A1), published on Sep. 21, 1995.*

*Primary Examiner* — Thai Ba Trieu
(74) *Attorney, Agent, or Firm* — Reinhart Boerner Van Deuren P.C.

(57) ABSTRACT

The present invention relates to an exhaust system for an internal combustion engine, more preferably of a motor vehicle, with an exhaust gas turbine, with an exhaust pipe, whose inlet is fluidically connected with an outlet of the exhaust gas turbine, with a flange connection for connecting the exhaust gas turbine with the exhaust pipe which comprises a flange fastened to the exhaust pipe and attached to the exhaust gas turbine, and with a shielding apron which is so arranged and/or incorporated in the flange connection that in the operation of the exhaust system it protects a transition region between the flange and the exhaust pipe from direct admission of exhaust gas.

19 Claims, 7 Drawing Sheets

U.S. PATENT DOCUMENTS

| | | | | |
|---|---|---|---|---|
| 6,247,552 | B1 * | 6/2001 | Kovar et al. | 60/323 |
| 6,688,103 | B2 * | 2/2004 | Pleuss et al. | 60/323 |
| 7,089,737 | B2 * | 8/2006 | Claus | 60/323 |
| 7,234,302 | B2 * | 6/2007 | Korner | 60/602 |
| 7,784,442 | B2 * | 8/2010 | Lester et al. | 123/193.5 |
| 7,802,428 | B2 * | 9/2010 | Perrin et al. | 60/602 |
| 7,908,857 | B2 * | 3/2011 | Nordling | 60/321 |
| 2004/0083730 | A1 * | 5/2004 | Wizgall et al. | 60/320 |
| 2005/0126163 | A1 * | 6/2005 | Bjornsson, Sr. | 60/323 |
| 2006/0131817 | A1 * | 6/2006 | Kerelchuk | 277/592 |
| 2007/0216109 | A1 * | 9/2007 | Friedow | 277/593 |
| 2007/0289954 | A1 * | 12/2007 | Bien et al. | 60/697 |
| 2009/0277172 | A1 * | 11/2009 | Nordling | 60/614 |
| 2010/0040465 | A1 * | 2/2010 | Moran et al. | 415/213.1 |
| 2010/0040467 | A1 * | 2/2010 | Mudel | 415/214.1 |
| 2010/0041287 | A1 * | 2/2010 | Woods et al. | 60/598 |
| 2010/0223911 | A1 * | 9/2010 | Gockel et al. | 60/323 |
| 2010/0295298 | A1 * | 11/2010 | Haumont et al. | 285/412 |
| 2011/0173972 | A1 * | 7/2011 | Wade et al. | 60/602 |
| 2011/0277466 | A1 * | 11/2011 | Danielewicz et al. | 60/598 |
| 2012/0023928 | A1 * | 2/2012 | Smatloch et al. | 60/598 |
| 2012/0023968 | A1 * | 2/2012 | Shteyman et al. | 60/796 |

FOREIGN PATENT DOCUMENTS

| | | | | |
|---|---|---|---|---|
| DE | 44 09 025 | A1 | | 9/1995 |
| DE | 19645384 | A1 | * | 5/1998 |
| DE | 19726750 | A1 | * | 1/1999 |
| DE | 10022502 | A1 | * | 4/2001 |
| DE | 19954317 | A1 | * | 5/2001 |
| DE | 101 29 916 | A1 | | 1/2003 |
| DE | 10307028 | B3 | * | 5/2004 |
| EP | 955453 | A2 | * | 11/1999 |
| FR | 2 863 307 | A1 | | 6/2005 |
| JP | 11006440 | A | * | 1/1999 |
| JP | 2009150393 | A | * | 7/2009 |
| JP | 2010144649 | A | * | 7/2010 |
| JP | 2010236383 | A | * | 10/2010 |
| JP | 2010255524 | A | * | 11/2010 |

* cited by examiner

EXHAUST SYSTEM

CROSS-REFERENCE TO RELATED PATENT APPLICATIONS

This patent application claims the benefit of co-pending German Patent Application No. DE 102008031887.6, filed on Jul. 8, 2008, the entire teachings and disclosure of which are incorporated herein by reference thereto.

FIELD OF THE INVENTION

The present invention relates to an exhaust system for an internal combustion engine, more preferably a motor vehicle. The invention also relates to a flange connection between a first component and a second component.

BACKGROUND OF THE INVENTION

In exhaust systems or in other systems conducting hot gases there is the problem in the region of flange connections that the flange connection is exposed to a relatively high thermal load. This is true more so when it concerns a built flange connection, wherein a separately manufactured flange is attached to a tubular component. Forming the flange connection, this component can then be attached to another component with the help of the flange.

These thermal problems occur with exhaust systems more preferably at the connecting point between an exhaust gas turbine and an exhaust pipe when an inlet of the exhaust pipe is fastened to an outlet of the exhaust gas turbine with the help of such a more preferably built flange connection. The thermal problems are amplified when for the sake of costs and/or for the sake of weight thinner and/or simpler materials of reduced quality are to be used.

These thermal problems can intensify if the exhaust gas turbine is equipped with a wastegate valve which in the open state generates a concentrated exhaust gas jet which strikes the exhaust pipe in a limited circumferential section with particularly hot exhaust gas and under high pressure.

BRIEF SUMMARY OF THE INVENTION

Embodiments of the present invention deal with the problem to state an improved embodiment for an exhaust system or for a flange connection of the type mentioned at the outset which is more preferably characterized in that increased thermal stability and strength is obtained and that increased service life or lifespan with thermal load is obtained.

According to embodiments of the invention, this problem is solved through the subjects of the independent claims. Advantageous embodiments are the subject of the dependent claims.

An embodiment of the invention is based on the general idea of protecting a transitional region, in which the flange is fastened to the corresponding component, from being directly loaded with hot gas with the help of a shielding apron. To this end, the shielding apron is arranged in a suitable manner and/or incorporated in the flange connection. The shielding apron, which preferentially with respect to the remaining components of the flange connection constitutes a separate component, can be designed with respect to its material selection simply so that it possesses increased thermal stability. More preferably a material having a higher quality and/or grade can be used for the shielding apron than the materials of the remaining components within the flange connection. Furthermore, the shielding apron can be easily designed geometrically, for example through a thin wall thickness, so that it requires only little weight and little material. In the installed state the shielding apron acts like a heat shield and accordingly protects the transitional region between the flange and the corresponding component. In this transitional region the flange is fastened to the corresponding component. Accordingly, the shielding apron protects this fastening between flange and component from thermal overload. The shielding apron can for example better distribute over a large area locally limited hot gas admissions, so called hot spots, which reduces thermal stresses. Furthermore, it can altogether better and more uniformly discharge and radiate heat if applicable. The use of such a shielding apron within a flange connection thus results in a significant improvement of the thermal stability and service life of the flange connection or an exhaust system equipped with such a shielding apron.

According to a preferred embodiment the shielding component can be designed as flange gasket which is installed in the flange connection axially between the flange and a flange contour of the exhaust gas turbine complementary thereto. Because of this, the shielding apron can be provided with a dual function.

Advantageous is an embodiment wherein the shielding apron overlaps the transitional region on a side facing the exhaust gas. Because of this, direct striking of the transitional region with hot gas is additionally made more difficult, which improves the protective effect of the shielding apron.

Further improvement of the thermal protective effect of the shielding apron can be achieved if the shielding apron axially dips into the exhaust pipe. In order to get to the transitional region, the exhaust gas would have to flow around the trailing edge of the shielding apron against the main flow direction, which is not possible or only with great difficulty.

According to a particularly advantageous embodiment a gap can be formed between the shielding apron and the exhaust pipe. Because of this, a gap insulation or "air gap insulation" is realised which brings about effective protection of the transitional region.

Further important features and advantages of the invention are obtained from the subclaims, from the drawings and from the corresponding figure description by means of the drawings.

It is to be understood that the features mentioned above and still to be explained in the following cannot only be used in the respective combination stated but also in other combinations or positioned on their own, without leaving the scope of the present invention.

BRIEF DESCRIPTION OF THE DRAWINGS

Preferred exemplary embodiments of the invention are shown in the drawings and are explained in more detail in the following description, while identical reference symbols refer to identical or similar or functionally identical components.

It shows, in each case schematically.

DETAILED DESCRIPTION OF THE INVENTION

Figure 1A:
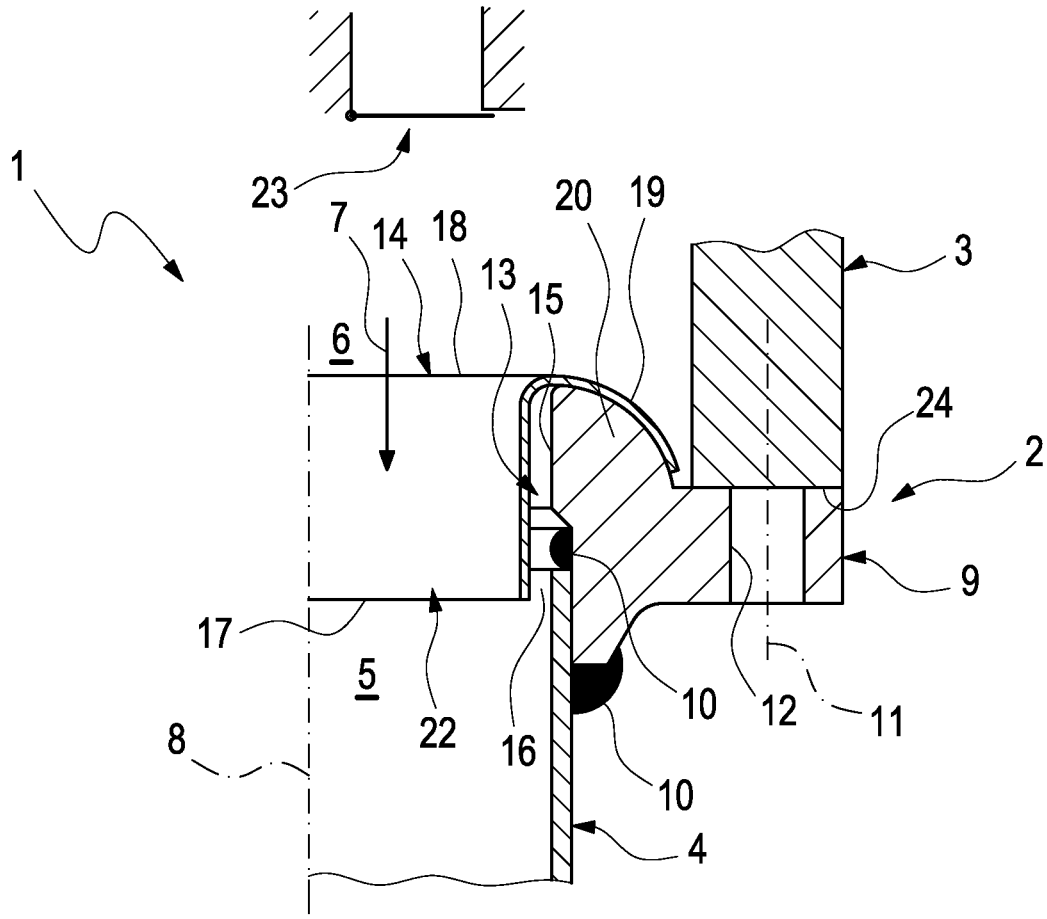
FIGS. 1*a* and 1*b* are in each case, highly simplified elementary sectional view of an exhaust system in the region of a flange connection, with various embodiments.
Figure 1B:
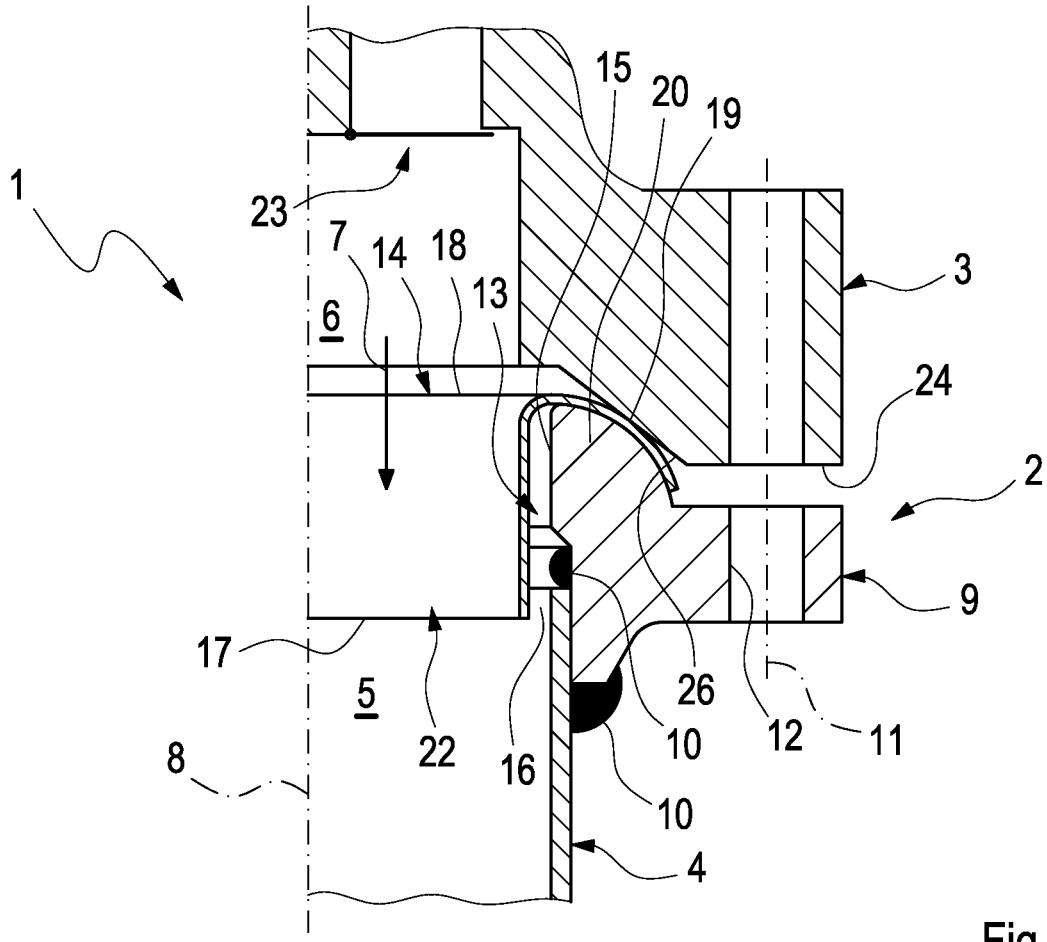
Figure 2:
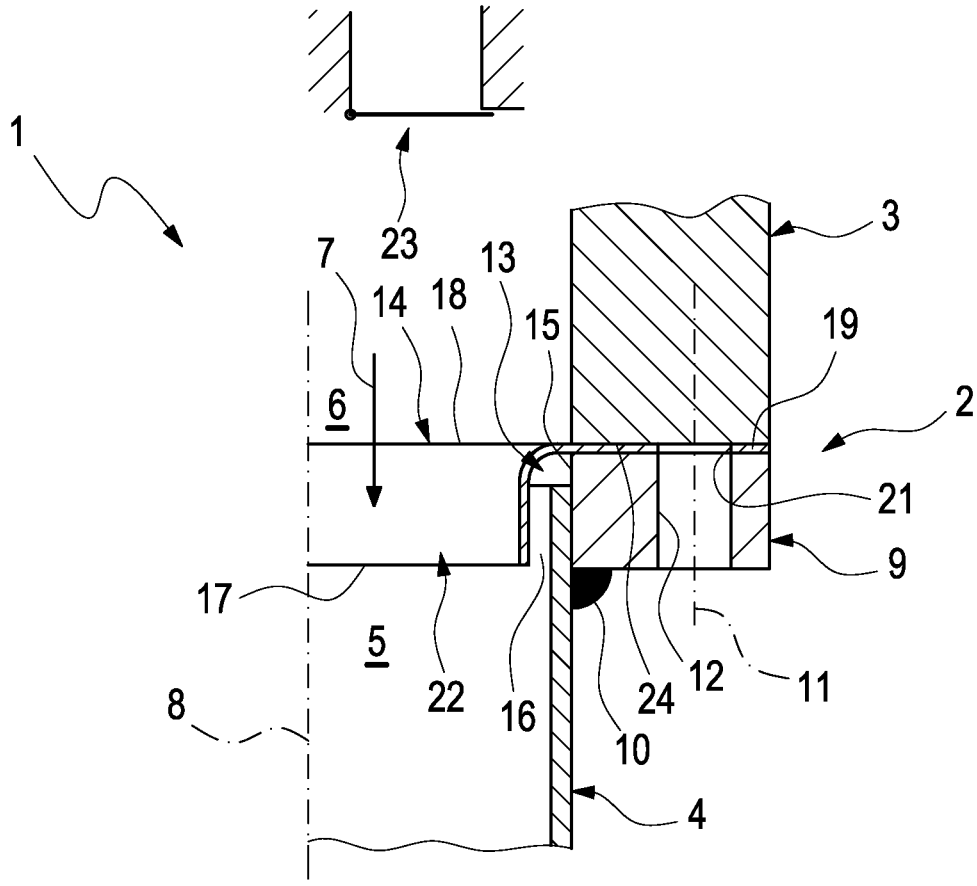
FIGS. 2 and 3 are views as in FIG. 1 of further embodiments
Figure 3:
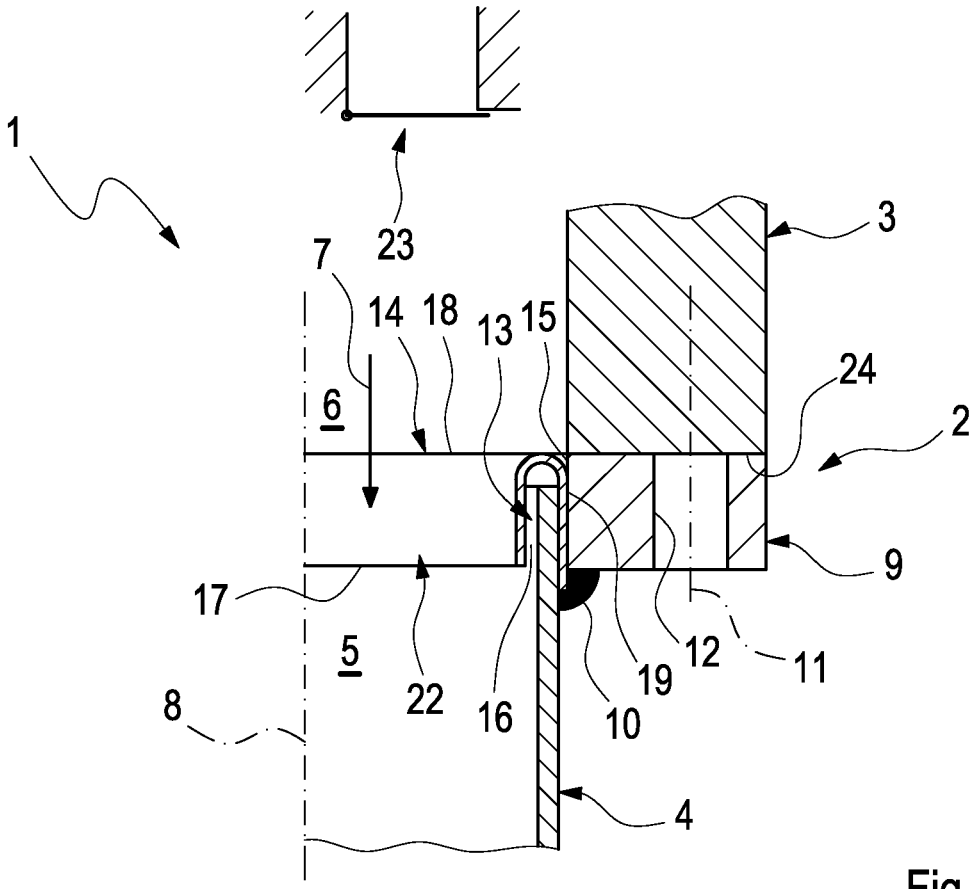

According to FIGS. 1 to 3 an exhaust system 1 shown only partly comprises at least one flange connection 2. The flange connection 2 in this case serves for the connecting of two components. In the present case that is for connecting two components of the exhaust system 1. A first component 3 in the case of the exhaust system 1 for example is an exhaust gas turbine which in the following is likewise designated exhaust gas turbine 3. Only a part of a housing is shown of the exhaust gas turbine 3. In addition, a waste gate valve 23, which can be optionally present, is indicated symbolically.

A second component 4 for example is a tubular component 4. In the case of the exhaust system 1 this is practically an exhaust pipe which in the following is likewise designated exhaust pipe 4. It can also be a funnel. The exhaust system 1 serves to discharge exhaust gases of an internal combustion engine which more preferably can be located in a motor vehicle. The exhaust gas turbine 3 shown only partially extracts energy from the exhaust gas and can convert this energy for example into mechanical drive power. The exhaust gas turbine 3 can be part of an exhaust gas turbocharger. In the following description, predominantly the designation "exhaust gas turbine 3" and "exhaust pipe 4" are used for the components 3 and 4 connected with each other with the help of the flange connection 2. It is clear that with another installation situation of the flange connection 2 the embodiments can then be similarly transferred to the general components 3, 4.

With the help of the flange connection 2 an inlet 5 of the exhaust pipe 4 is fluidically connected with an outlet 6 of the exhaust gas turbine 3. In operation of the exhaust system 1, exhaust gas can thus enter the exhaust pipe 4 from the exhaust gas turbine 3 through a main flow direction 7 of an exhaust gas flow indicated by an arrow. Practically inlet 5 and outlet 6 are designed rotation-symmetrically, more preferably circularly or circular-cylindrically, which is indicated in FIGS. 1 to 3 by an axis of symmetry 8. In principle, other geometries can also be provided.

The flange connection 2 comprises a flange 9. This is attached to the exhaust pipe 4 and mounted to the exhaust gas turbine 3. To this end, the exhaust gas turbine 3 practically has a flange contour 24 which is complementary to the flange 9. Preferentially the flange 9 is embodied ring-shaped and is centrally open. It is arranged radially outside on the exhaust pipe 4 so that it stands away from the exhaust pipe 4 radially to the outside. Furthermore, the flange 9 is arranged in the region of the inlet 5 on the exhaust pipe 4. The attachment of the flange 9 to the exhaust pipe 4 in the example is performed by means of at least one welded connection 10. In the example of FIG. 1, two ring-shaped circumferential weld seams 10 are shown. In the examples of FIGS. 2 and 3, only a single ring-shaped circumferential weld seam 10 is shown in each case. In principle, a soldered connection can also be provided in order to attach the flange 9 to the exhaust pipe 4. The attachment of the flange 9 to the exhaust gas turbine 3 is preferably via screw connections 11, which here is merely indicated by a dash-dotted line. Suitable fastening screws or screw bolts or threaded rods penetrate the flange 9 in corresponding through openings 12 and are anchored in the exhaust gas turbine 3 in a suitable manner. For example fastening screws, which penetrate the through openings 12 are screwed into the exhaust gas turbine 3.

In order to be now able during operation of exhaust system 1 to protect a transitional region 13 between the flange 9 and the exhaust pipe 4 from direct admission of the exhaust gas the flange connection 2 additionally comprises a shielding apron 14. The latter is preferably embodied on a shielding component 22, more preferably integrally moulded thereon. The shield component 22 forms a separate component with respect to the flange 9 and with respect to the exhaust pipe 4 as well as with respect to the exhaust gas turbine 3. The shielding apron 14 is arranged within the flange connection 2 so that it prevents direct exhaust gas admission to the transitional region 13. The shielding apron 14 for this purpose is so designed that it overlaps the transitional region 13 in the installed state on a side facing the exhaust gas at least along a part of the circumference. With the shown embodiments, the shielding apron 14 dips into the exhaust pipe 4 in axial direction for this purpose.

With the embodiments of FIGS. 1 and 2 the shielding apron 14 is attached to the flange 9 on a side facing away from the exhaust pipe 4. The shielding apron 14 then extends axially through a central opening 15 of the flange 9 as far as into the region of the transition region 13 or axially overlapping beyond said region as far as into the exhaust pipe 4.

With the embodiments shown here the shielding apron 14 is so integrated in the flange connection 2 that between the shielding apron 14 and the exhaust pipe 4 a gap 16 is formed. As a result of this, an extremely effective gap insulation is realised which in addition to the heat shield function of the shielding apron 14 avoids direct heat transfer from the shielding apron 14 to the transition region 13. In the gap 16, only a heat transfer through heat radiation substantially occurs, which is comparably easily controllable.

The gap 16 is open on one side in axial direction. This axially open end of the gap 16 is practically located on the trailing end. The exhaust flow 7 would have to flow around a trailing end 17 of the shielding apron 14 against the flow directions 7 in order to get to the gap 16. This is relatively improbable.

Through the design of the gap 16 it is additionally possible to arrange the shielding apron 14 within the flange connection 2 so that it is arranged without touching or contacting relative to the exhaust pipe 4 on a side of the exhaust pipe 4 facing the exhaust gas flow 7. Thus direct heat transfer from the shielding apron 14 to the exhaust pipe 4 can be avoided.

The shielding apron 14 can be attached to the flange 9 in the embodiment corresponding to the one shown in FIG. 1. For example the shielding apron 14 in the region of its leading edge 18 possesses a collar 19 that stands away to the outside which axially supports itself on a shoulder 20 of the flange 9. Here, the collar 19 and the shoulder 20 can have complementary contours which makes possible a large-area contact. More preferably the shielding apron 14 can be soldered to the flange 9. Spot welds or other connecting techniques are likewise conceivable. In the example of FIG. 1*a* the shielding apron 14 is exclusively fastened to the flange 9. In contrast with this, FIG. 1*b* shows an embodiment wherein the collar 19 is incorporated in a ball-cone connection which makes possible a connection that is adjustable with respect to the angle between exhaust pipe 4 and turbocharger 3. To this end, the shoulder 20 provided on the flange 9 is designed crowned or ball segment shaped, while a section of the turbocharger 3 interacting with this is designed as cone 26 which on the outside comes to bear against the shoulder 20 via the collar 19 arranged in between.

With the embodiment shown in FIG. 2 the shielding apron 14 is installed in the connection between flange 9 and exhaust gas turbine 3. This is achieved through a suitable configuration of the collar 19 which in this case protrudes as far as into the connection, i.e. as far as into the screw connections 11. Said collar 19 is then axially arranged between the flange 9 and the exhaust gas turbine 3. The screw connection 11 penetrates the collar 19, for which said collar is equipped with corresponding through-openings 21. With this embodiment the shielding apron 14 can direct the heat absorbed from the exhaust gas into the flange 9 and into the exhaust gas turbine 3. This effectively protects the transition region 13.

Particularly practical is an embodiment wherein the shielding apron 14 is designed as flange seal or acts as flange seal. The collar 19 to this end is designed closed in circumferential direction. Practically the collar 19 is formed complementarily to the surfaces of flange 9 and flange contour 24 which interact with each other. Furthermore the shielding apron 14 in this case consists of a material which is particularly suitable for effective sealing of the flange connection 2. Alternatively it can be provided that between the collar 19 and the flange 9 on the one hand and the flange contour 24 on the other hand to arrange a seal or a flange seal which consists of a material particularly suitable for this, while the shielding apron 14 consists of a particularly heat-resistant material. The respective flange seal can be attached to the shielding apron 14 or its collar 19, for example through crimping or folding over.

With the embodiment shown in FIG. 3 the shielding apron 14 is arranged completely within the central opening 15 of the flange 9. In the example, the shielding apron 14 is incorporated in the fastening between flange 9 and exhaust pipe 4. To this end, the shielding apron 14 is designed U-shaped in profile. In other words, the collar 19 is bent over approximately by 180° so far until it re-extends axially. The collar 19 with its axial section extends into the transition area 13. Here it is radially arranged between the exhaust pipe 4 and the flange 9. More preferably the collar 19 can extend as far as into the weld seam 10 so that the weld seam 10 simultaneously brings about also a fixing of the shielding apron 14. It is likewise possible to solder the shielding apron 14 to the exhaust pipe 4 and/or to the flange 9 or fix it through spot welds.

It is clear that the embodiments shown can in principle also be combined in any way if practical.

The wall thickness of the shielding apron 14 is practically selected smaller than a wall thickness of the exhaust pipe 4 in the transition region 13. For example the wall thickness of the shielding apron 14 is maximally half the size of the wall thickness of the exhaust pipe 4 in the transition region 13. Practically the shielding apron 14 is a sheet metal part or a formed sheet metal part. It can consist of a material, more preferably of metal, whose thermal stability is greater than that of the material of which the exhaust pipe 4 and/or the flange 9 and/or the exhaust gas turbine 3 or its housing and/or the respective weld seam 10 consists or consist. For the shielding apron 14 a material of higher grade or quality can be used. In other words, a material having a comparatively low grade or quality can thus be used for the exhaust pipe 4 and/or for the flange 9 and/or for the respective weld seam 10 and/or for the exhaust gas turbine 3 or for its housing.

The shielding apron 14 can extend along the total circumference of the exhaust pipe 4. More preferably it can then be embodied like a sleeve or shielding sleeve which extends rotation-symmetrically to the axis of symmetry 8. In this case the gap 16 which is likewise present is practically configured as circumferential ring gap 16 closed in circumferential direction.

Figure 4A:
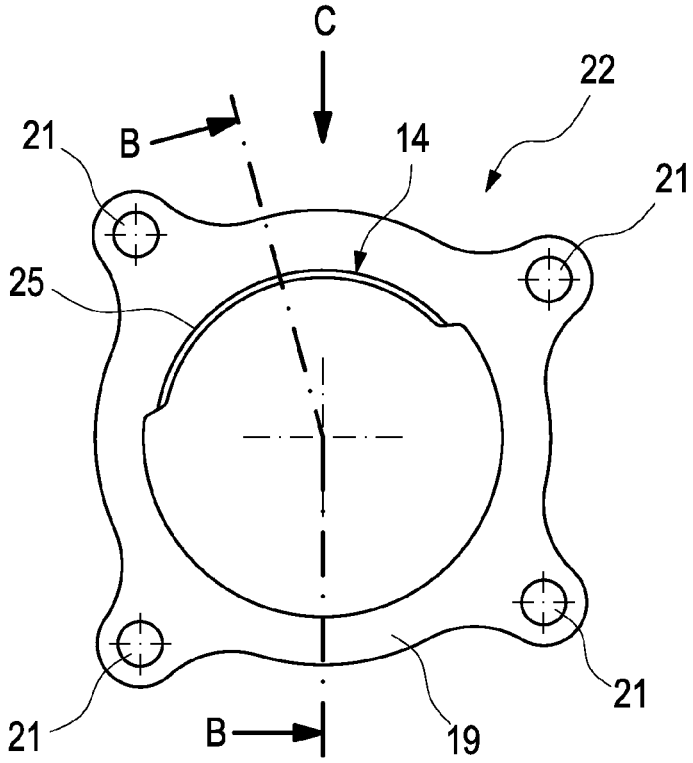
FIGS. 4*a*, 4*b*, 4*c*, 5*a*, 5*b*, 5*c*, 6*a*, 6*b*, and 6*c* are an axial view (a) as well as a sectional view (b) and a lateral view (c) each of a shielding component of various embodiments.
Figure 4B:
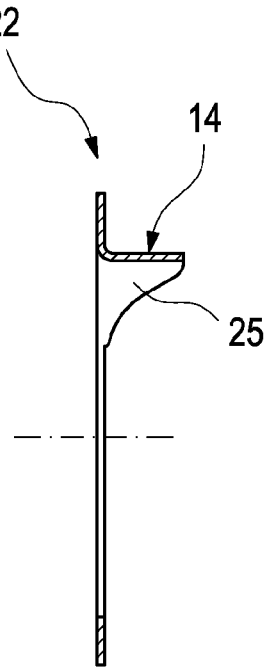
Figure 4C:
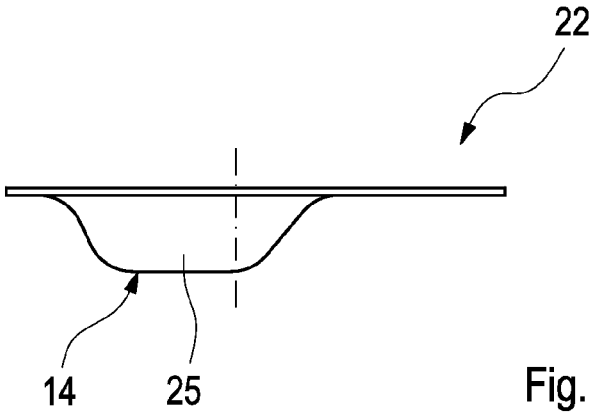
Figure 5A:
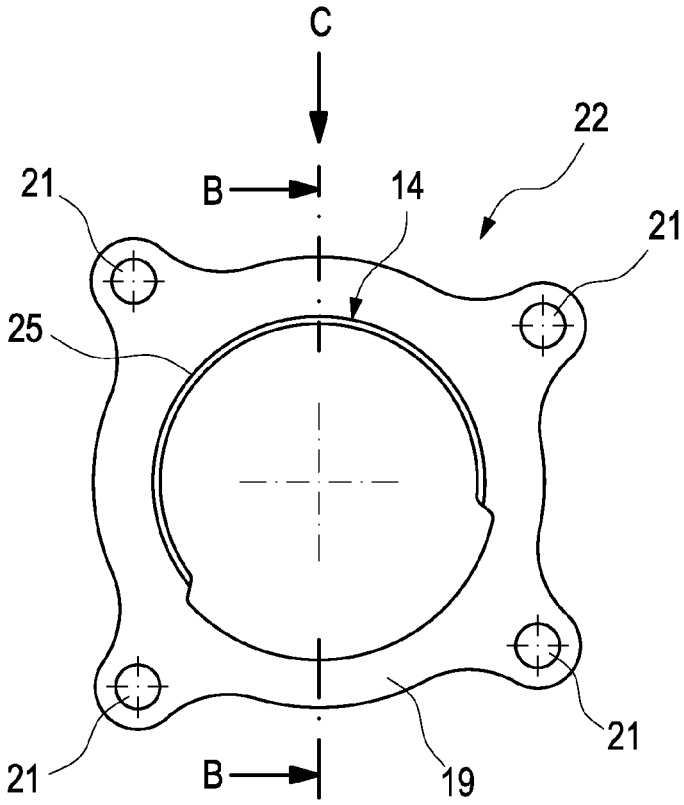
Figure 5B:
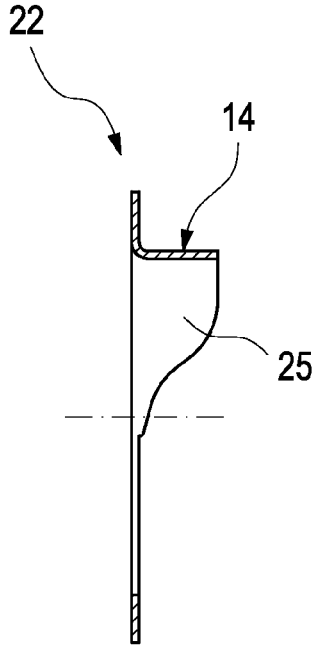
Figure 5C:
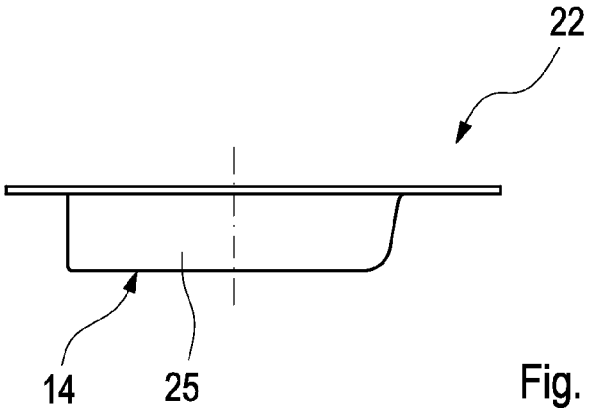
Figure 6A:
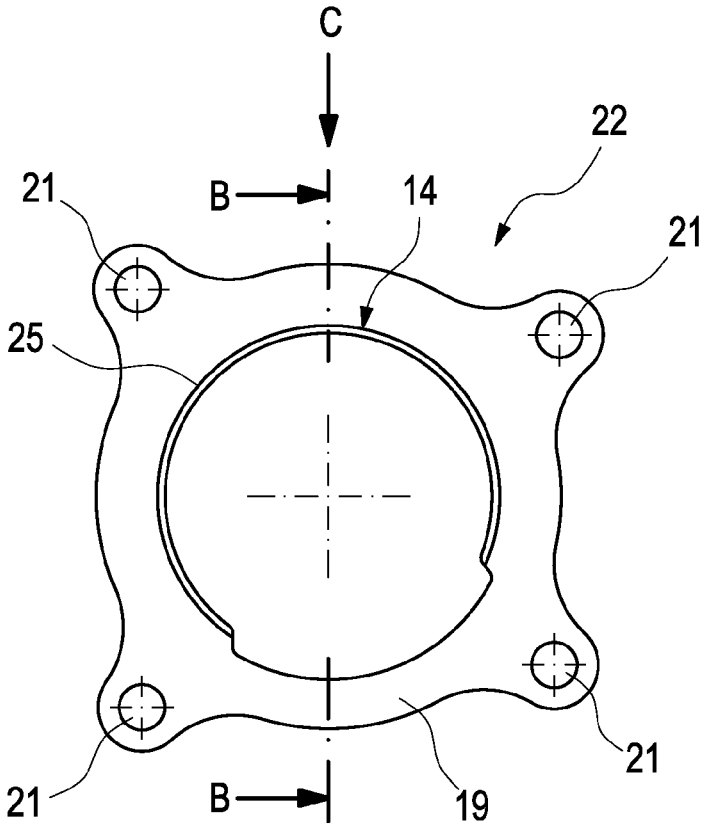
Figure 6B:
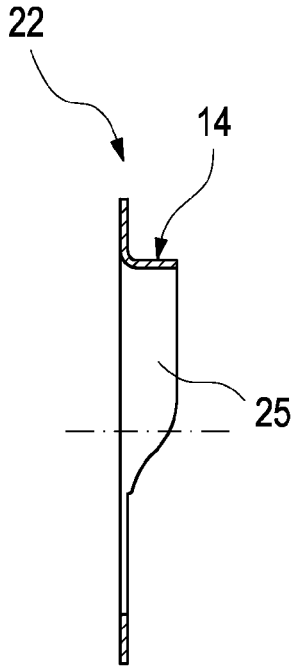
Figure 6C:
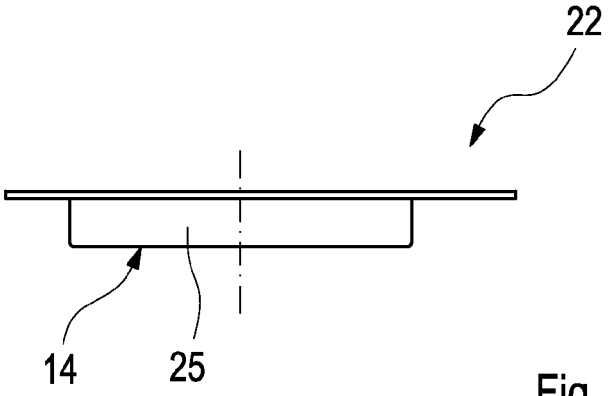

Alternatively it is likewise possible to design the shielding apron 14 so that it only extends in circumferential direction along a part circumference of the exhaust pipe 4. FIGS. 4 to 6, in each case a to c show examples of such embodiments. FIGS. 4*a*, 5*a* and 6*a* each show an axial view of the shielding component 22. FIGS. 4*b*, 5*b* and 6*b* each show a longitudinal section through the shielding component 22 corresponding to the section lines B-B in FIGS. 4*a*, 5*a* and 6*a*. FIGS. 4*c*, 5*c* and 6*c* each show a lateral view of the shielding component 22 corresponding to a view direction C in FIGS. 4*a*, 5*a* and 6*a*.

In contrast with the embodiments mentioned before, wherein the shielding apron 14 extends closed in circumferential direction, these segment-like shielding aprons 14 are characterized by reduced through-flow resistance at the transition region 13. Furthermore, they can be realised more economically and with lower weight. In FIGS. 4*a*, 5*a* and 6*a* an apron section is designated 25.

For example the shielding apron 14 or its respective apron section 25 can only extend along a part circumference of the exhaust pipe 4 in circumferential direction which in operation of the exhaust system 1 is subjected to an exhaust gas on flow which is created with the waste gate valve 23 opened. Because of this, the overheating protection is specifically realised there and more preferably realised only where the greatest thermal load is expected.

Practically the shielding apron 14 or its respective apron section 25 extend in circumferential direction only along a part circumference of the exhaust pipe 4 of at least 90° and/or a maximum of 270°. For example FIG. 4 shows an embodiment wherein the shielding apron 14 or its apron section 25 extend in circumferential direction by approximately 120° along the circumference of the exhaust pipe 4. In contrast with this, FIGS. 5 and 6 each show an embodiment wherein the circumferential extension of the shielding apron 14 or the shielding section 25 is greater than 180°. Thus FIG. 5 shows an embodiment wherein the shielding apron 14 or its apron section 25 extends in circumferential direction approximately 200° along the circumference of the exhaust pipe 4, while FIG. 6 shows an embodiment wherein the shielding apron 14 or its apron section 25 extends in circumferential direction approximately 270° along the circumference of the exhaust pipe 4.

What is claimed is:

1. An exhaust system for an internal combustion engine, comprising:

an exhaust gas turbine, an exhaust pipe, whose inlet is fluidically connected with an outlet of the exhaust gas turbine, a flange connection for connecting the exhaust gas turbine with the exhaust pipe having a flange fastened to the exhaust pipe and attached to the exhaust gas turbine, a shielding apron which is arranged and so incorporated in the flange connection that in operation of the exhaust system the shielding apron protects a transition region between the flange and the exhaust pipe against direct admission of exhaust gas wherein the shielding apron overlaps the transition region.

2. The exhaust system according to claim 1, wherein the shielding apron is designed on and integrally moulded on a shielding component and, which with respect to the exhaust pipe and with respect to the exhaust gas turbine forms a separate component.

3. The exhaust system according to claim 2, wherein the shielding component is embodied as a flange seal or at least comprises such, which is installed in the flange connection axially between the flange and a flange contour of the exhaust gas turbine complementary thereto.

4. The exhaust system according to claim 1, wherein the shielding apron is so arranged that the shielding apron overlaps the transition region on a side facing the exhaust gas.

5. The exhaust system according to claim 1, wherein the shielding apron is so arranged that the shielding apron axially dips into the exhaust pipe.

6. The exhaust system according to claim 1, wherein the shielding apron extends in circumferential direction only along a part circumference of the exhaust pipe.

7. The exhaust system according to claim 6, wherein the shielding apron in circumferential direction only extends along a part circumference of the exhaust pipe from at least 90° and maximally 270°.

8. The exhaust system according to claim 1, wherein the shielding apron extends in circumferential direction along the total circumference of the exhaust pipe.

9. The exhaust system according to claim 8, wherein the gap is embodied as closed circumferential ring gap.

10. The exhaust system according to claim 1, wherein the shielding apron is so arranged that between the shielding apron and the exhaust pipe a gap is formed.

11. The exhaust system according to claim 10, wherein the gap is axially open on one side, more specifically on the trailing end side.

12. The exhaust system according claim 1, wherein the shielding apron relatively to the exhaust pipe is arranged without contact on a side of the exhaust pipe facing the exhaust gas.

13. The exhaust system according to claim 1, wherein the shielding apron is attached to the flange.

14. The exhaust system according to claim 1, wherein the shielding apron is installed in the connection between the flange and the exhaust gas turbine.

15. The exhaust system according to claim 1, wherein the shielding apron is incorporated in the attachment between the flange and the exhaust pipe.

16. The exhaust system according to claim 1, wherein a wall thickness of the shielding apron is smaller than a wall thickness of the exhaust pipe, wherein the wall thickness of the shielding apron is a maximum of half the size of the wall thickness of the exhaust pipe.

17. The exhaust system according to claim 1, wherein the shielding apron is embodied as formed sheet metal part.

18. The exhaust system according to claim 1, wherein the shielding apron consists of a material whose thermal stability is greater than that of the material of at least one of the exhaust pipe, the flange, or the exhaust gas turbine.

19. An exhaust system for an internal combustion engine, comprising:

an exhaust gas turbine, an exhaust pipe, whose inlet is fluidically connected with an outlet of the exhaust gas turbine, a flange connection for connecting the exhaust gas turbine with the exhaust pipe having a flange fastened to the exhaust pipe and attached to the exhaust gas turbine, a shielding apron which is arranged and so incorporated in the flange connection that in operation of the exhaust system the shielding apron protects a transition region between the flange and the exhaust pipe against direct admission of exhaust gas;

wherein the shielding apron extends in circumferential direction only along a part circumference of the exhaust pipe; and wherein the exhaust turbine comprises a wastegate valve, wherein the shielding apron only extends along a part circumference of the exhaust pipe in circumferential direction which in operation of the exhaust system is exposed to an exhaust gas onflow which develops with opened wastegate valve.

* * * * *